United States Patent [19]

Martin

[11] Patent Number: 4,692,948

[45] Date of Patent: Sep. 15, 1987

[54] SINK STRAINER HAVING A MAGNET

[75] Inventor: Joseph R. Martin, Highland Beach, Fla.

[73] Assignee: Jomar International, Ltd., Royal Oak, Mich.

[21] Appl. No.: 945,029

[22] Filed: Dec. 22, 1986

[51] Int. Cl.[4] ..... E03C 1/26

[52] U.S. Cl. ..... 4/286; 206/818

[58] Field of Search ..... 4/286–292; 220/230; 206/818; 277/80; 248/206.5; 49/478; 24/49 M; 251/65

[56] References Cited

U.S. PATENT DOCUMENTS

| | | | |
|---|---|---|---|
| 2,217,514 | 10/1940 | Henry | 206/818 |
| 2,672,257 | 3/1954 | Simmonds | 220/230 |
| 3,251,461 | 5/1966 | Smith | 220/230 |
| 3,365,684 | 1/1968 | Stemke et al. | 206/818 |
| 3,931,651 | 1/1976 | Weir | 4/580 |
| 3,961,721 | 6/1976 | Gordon et al. | 220/230 |
| 4,090,265 | 5/1978 | Baus | 4/580 |
| 4,110,552 | 8/1978 | Lombardi | 220/230 |
| 4,610,145 | 9/1986 | Arzberger et al. | 62/419 |

FOREIGN PATENT DOCUMENTS

| | | | |
|---|---|---|---|
| 1046488 | 7/1953 | France | 206/818 |

*Primary Examiner*—Henry J. Recla
*Assistant Examiner*—L. J. Peters
*Attorney, Agent, or Firm*—Robert G. Mentag

[57] ABSTRACT

A sink strainer having a hollow strainer body with an open upper end and an outlet portion at the lower end thereof in which is carried an outlet drainage plate. A basket strainer is operatively mounted in the strainer body and it is movable between an open position and a closed position. A permanent magnet means is provided to assist the water in a sink to create of a strong sealing action between the basket strainer and the strainer body outlet plate when the basket strainer is in the closed position.

4 Claims, 6 Drawing Figures

SINK STRAINER HAVING A MAGNET

BACKGROUND OF THE INVENTION

1. Technical Field

The field of art to which this invention pertains may be generally located in the class of devices relating to sink strainers. Class 4, Subclass 286, Sink Strainers and Stoppers United States Patent Office Classification, appears to be the applicable general area of art to which the subject matter similar to this invention has been classified in the past.

2. Background Information

This invention relation relates to sink strainers, and more particularly to the type of sink strainer used with kitchen sinks or the like. Sink strainers of the type to which this invention is directed generally include a substantially large body in which is seated a basket strainer having a rubber stopper. The basket strainers are adapted to be moved manually between opened and closed positions to permit draining and filling of the sink. Heretofore, basket strainers of this type have relied on the weight of the water in the sink to push the basket strainer's rubber stopper against the strainer body to prevent leakage of water from the sink when it is desired to retain water in the sink. However, it has been found that the weight of water in the sink does not create enough downward force to provide a leakproof seal, and accordingly, there is always some leakage by such prior art basket strainers. Heretofore, attempts have been made to provide a strainer basket or crumb cup which has a valve disc which is adapted to seat and close the drain opening in the strainer upon rotational movement of a valve stem in one direction, and conversely to open the drain upon a rotational movement of the valve stem in the opposite direction. The last mentioned type of sink strainer structure is shown in the prior art U.S. Pat. No. 2,890,463. A disadvantage of the prior art sink strainer shown in the last mentioned patent is that it is expensive to make and requires maintenance to keep the rotational parts of the valve clean.

SUMMARY OF THE INVENTION

In accordance with the present invention, a sink strainer for a kitchen sink or the like, is provided which has a hollow strainer body with an open upper end and an outlet portion at the lower end. An outlet drainage plate is carried in the outlet portion of the strainer body. A basket strainer is operatively mounted in the strainer body and is adapted to be moved in the strainer body between an opened and a closed position. The basket strained is provided with a rubber stopper on the lower end thereof. The outlet plate in the strainer body is provided with a plurality of drainage holes and the basket strainer is also provided with a plurality of drainage holes.

In one embodiment a magnet means is embedded in the rubber stopper which is carried on the lower side of the basket strainer and which functions when the basket strainer is in a closed position to create a magnetic attraction with the outlet plate so as to form a strong sealing action with the outlet plate and block the drainage holes in the outlet plate. The magnetic attraction assists the weight of the water in a sink which normally would press downwardly on the basket strainer to push the rubber stopper into sealing action against the outlet plate. In another embodiment the magnet means is disposed below the outlet plate and functions with a metal member embedded in the rubber stopper on the basket strainer to provide a magnetic attraction between the basket strainer and the outlet plate to provide a strong sealing action, together with the weight of the water on the top of the basket strainer.

DESCRIPTION OF THE PREFERRED EMBODIMENT

Figure 2:
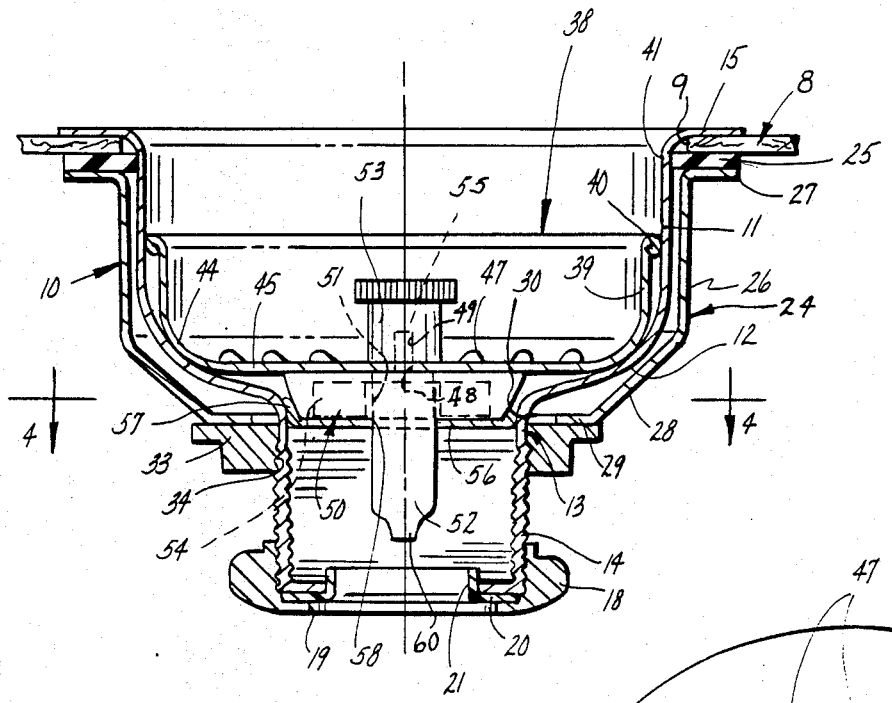
FIG. 2 is an elevation section view of the sink strainer illustrated in FIG. 1, taken along the line 2—2 thereof, and looking in the direction of the arrows.

Referring now to FIG. 2, a sink is generally indicated by the numeral 8, which is provided with the usual relatively large diameter opening 9 therein, in which a sink strainer, generally indicated by the numeral 10 and made in accordance with the principles of the present invention, is mounted. The sink strainer 10 comprises a substantially cylindrical body member which has a circular upper end 11 and an integral concave lower end 12. The sink strainer body has a tubular outlet, generally indicated by the numeral 13, which is formed integral at its upper end with the lower end of the concave body lower end portion 12. As shown in FIG. 2, the lower end portion of the outlet tubular member 13 is provided on its lower end with an integral threaded portion 14. A flange 15 is integrally formed around the upper edge of the sink strainer body upper end portion 11.

A conventional slip nut 18 is threadably mounted on the lower threaded end portion 14 of the outlet 13, and it functions with a suitable washer 20 for maintaining a conventional tail piece in the lower end 14 of the outlet 13. The upper end of the conventional tail piece would extend through a circular hole 19 in the slip nut 18 and through a bore 21 formed through the washer 20. The washer 20 may be any conventional washer, made from any suitable material, such as plastic, rubber or the like.

As shown in FIG. 2, the sink strainer body is held in the opening 9 in the sink 8 by a cup-shaped clamp, generally indicated by the numeral 24. The clamp 24 has an upper cylindrical body portion 26 with an integral flange 27 on the upper edge thereof, which engages the lower side of an annular gasket 25 for clamping the sink strainer 10 in place on the sink 8. The clamp 24 further includes a lower body portion 28 which is integral with the upper body portion 26 and which converges downwardly at its lower end. The clamp lower body portion 28 is integral with a flat body portion 29 through which is formed a central opening 30. The clamp 24 is held in an operative position against the lower side of the gasket 25 by a suitable lock nut 33 which is provided with a threaded opening 34. The lock nut 33 is threadably mounted on the threaded lower end portion 14 of the outlet 13. It will be seen that when the lock nut 33 is threaded upwardly, it creates a pressure on the flat body portion 29 of the clamp 24 to force the clamp flange 27 upwardly into a compression engagement with the lower side of the gasket 25 while simultaneously creating a downward clamping force of the flange 15 on the top of the sink 8.

Figure 1:
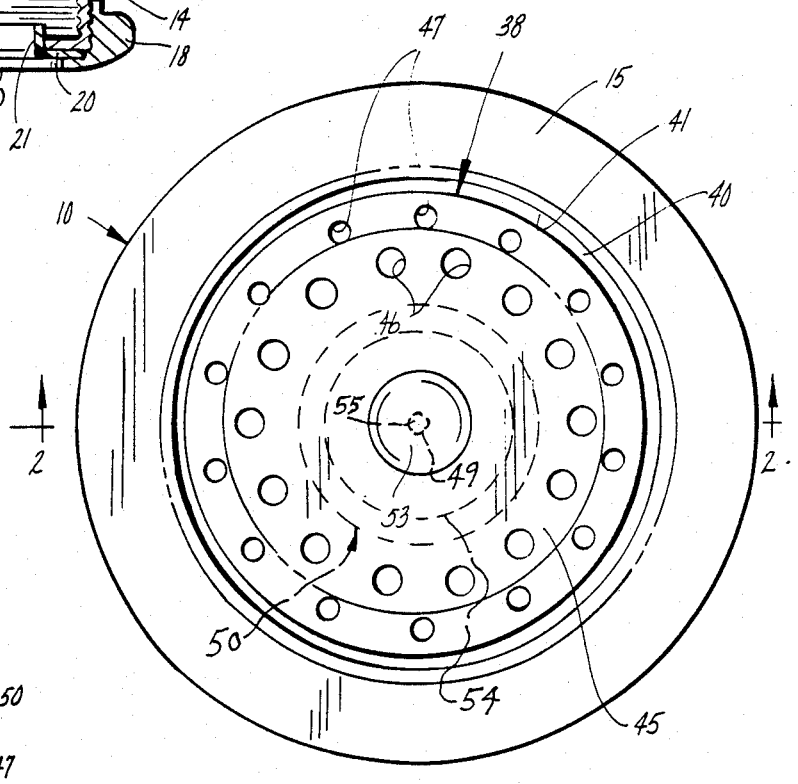
FIG. 1 is a top plan view of a sink strainer made in accordance with the principles of the present invention.
Figure 3:
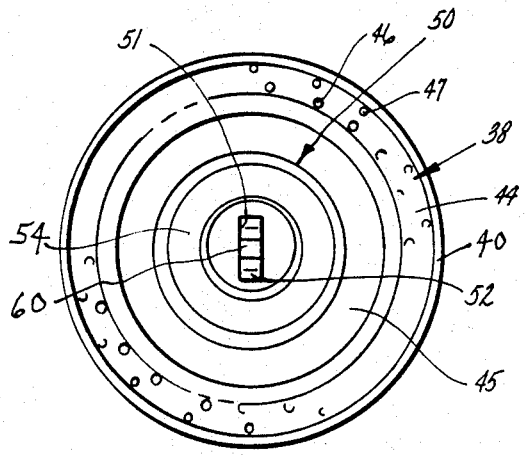
FIG. 3 is a reduced bottom end view of the basket strainer employed in the sink strainer embodiment of FIGS. 1 and 2.

As shown in FIGS. 1, 2 and 3, the sink strainer 10 includes a basket strainer, generally indicated by the numeral 38. The basket strainer 38 has a substantially cylindrical upper body portion 39, as shown in FIG. 2. A rolled peripheral edge or bead 40 is formed on the upper end of the basket strainer upper body portion 39, and it is adapted to slidably engage the interior chamber 41 in the sink strainer body. The basket strainer 38 includes an integral, concave lower portion 44 which is integral with a flat or transverse body wall portion 45. As best seen in FIG. 1, the basket strainer 38 is provided with an inner ring of drainage openings 46 and an outer ring of drainage openings 47, formed through the bottom wall flat portion 45.

As shown in FIGS. 1 and 2, the basket strainer 38 is provided on the lower side thereof, with a rubber stopper, generally indicated by the numeral 50. The rubber stopper 50 has a hole 51 formed therethrough and through which is press fitted a blade-like post 52 having a rectangular cross section. The post 52 has a cylindrical, integral shaft 55 formed on the upper end thereof. The post shaft 55 extends upwardly through a hole 48 formed in the basket strainer bottom end wall 45 and into an axial hole 49 formed in the lower end of a hand knob 53. The post shaft 55 is secured in the hole 49 in the knob 53 by any suitable means, as by a press fit. The lower end of the knob 53 seats on the upper surface of the basket strainer bottom wall 45.

A circular, permanent magnet, indicated by the numeral 54 is embedded in the rubber stopper 50, as shown in FIG. 3.

Figure 4:
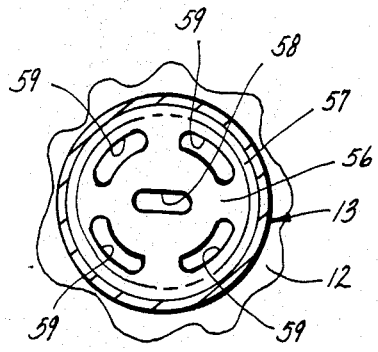
FIG. 4 is a fragmentary, horizontal, section view, with parts removed, of the sink strainer structure illustrated in FIG. 2, taken along the line 4—4 thereof, and looking in the direction of the arrows.

As shown in FIG. 2, an outlet plate 56 is seated in the upper end of the strainer body outlet 13, and it is circular and provided with an upwardly extended peripheral flange 57 which is secured to the outlet 13 by any suitable means, as by welding. The outlet plate 56 is circular in plan view, as shown in FIG. 4, and it is provided with an elongated hole therethrough, indicated by the numeral 58, for the sliding reception of the basket strainer post 52. The strainer body outlet plate 56 is also provided with a plurality of drain openings 59 which are annularly and equally spaced apart, as shown in FIG. 4. As shown in FIGS. 2 and 3, the lower end of the post 52 on the strainer basket 38 is provided with a reduced cross section end portion 60.

In use, the basket strainer 38 would be in the position shown in FIG. 2 for closing the drain holes 59 formed through the basket strainer outlet plate or seat 56. When the basket strainer 38 is in the position shown in FIG. 2, it will be seen that the rubber stopper 50 is operatively pressed against the outlet plate 56 by not only the weight of the water in a sink but also by the magnetic attraction force which the permanent magnet 54 creates by its attraction to the metal outlet plate 56, which is conductively connected to the strainer body. It will be understood that all of the aforedescribed elements of the sink strainer 10 are made from a metal which is magnetically attracted to the magnet 54. The strainer body and basket 38 are preferably make from a stainless steel. In order to move the basket strainer 38 to an open position, to let water drain from the sink 8 and out through the outlet openings 59 in the outlet plate 56, the user of the basket strainer 38 would grasp the knob 53 and pull the basket strainer 38 upwardly so as to remove the post 52 completely out of the opening 58 in the outlet plate 56. The basket strainer 38 would then be rotated to a position 90 degrees from the position shown in FIG. 2 and then it would be moved downwardly so as to move the lower reduced size end portion 60 of the post 52 into a crosswise position in the elongated slot 58 in the outlet plate 56, whereby the post 52 then rests on the shoulders formed between reduced post end 60 and the upper enlarged end of 52 to hold the basket strainer 38 in a position elevated above the outlet plate 56 to permit water to drain through the openings 46 and 47 and then down through the outlet openings 59 in the outlet plate 56 and into the outlet 13. It will be seen that the magnet 54 in the rubber stopper 50 provides a much stronger seal with the outlet plate 56, because of the magnetic attraction between the magnet 54 and the metal strainer body when the basket strainer 38 is in the closed position shown in FIG. 2, then the closing downward force which is provided by only the weight of the water in the sink 8.

Figure 5:
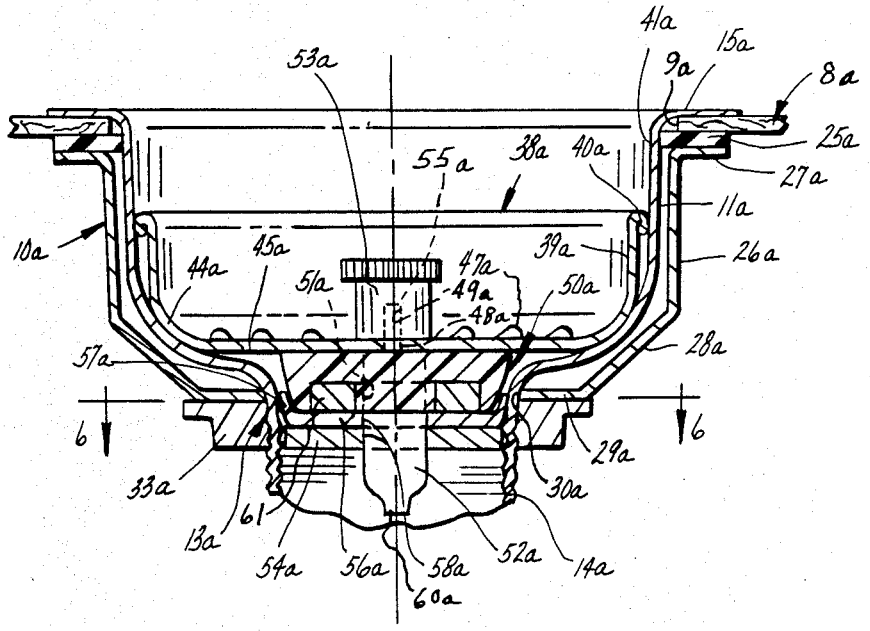
FIG. 5 is an elevation section view, similar to FIG. 2, and illustrating a second embodiment of the invention.
Figure 6:
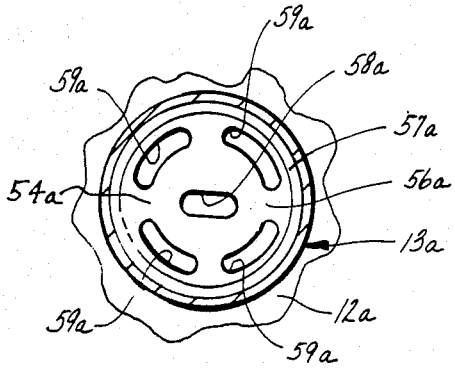
FIG. 6 is a fragmentary, horizontal, section view, with parts removed, of the sink strainer structure illustrated in FIG. 5, taken along the line 6—6 thereof, and looking in the direction of the arrows.

FIGS. 5 and 6 illustrate a second embodiment of the invention, and the parts thereof which are the same as the parts employed in the first embodiment of FIGS. 1 through 4 have been marked with the same reference numerals followed by the small letter "a".

As shown in FIG. 6, the outlet plate **56*a* has the same outlet holes 59*a* as employed in the first embodiment. In the second embodiment of FIGS. 5 and 6, a cylindrical, permanent magnet 54*a* is operatively mounted in the outlet 13*a* in a position against the lower side of the outlet plate 56*a*. The magnet 54*a* is held in position in the outlet 13*a*** by any suitable means, as by welding or a press fit.

The rubber stopper **50*a* has embedded therein an annular metal member 61 which is exposed to the exterior of the rubber, at the bottom of the rubber stopper 50*a*, and which is adapted to be magnetically attracted by the magnet 54*a* to hold the basket strainer 38*a* in an efficient sealing, closed position, as shown in FIG. 5. The basket strainer 38*a* would be moved to the open position in the same manner as described hereinbefore for the first embodiment. That is, a user would pull upwardly on the knob 53*a* until the post 52*a* is clear of the outlet plate 56*a*, then the basket strainer 38*a* would be turned 90 degrees so that the lower reduced size lower end 60*a* on the post 52*a* could be inserted downwardly and crosswise into the slot 58*a* of the outlet plate 56*a* to hold the strainer 38*a* in a position with the stopper 50*a* raised upwardly and spaced apart from the outlet plate 56*a*. The post 52*a* would extend downwardly through a hole in the magnet which is the same size and shape as the hole 58*a* in the outlet plate 54*a* and this is indicated by the same numeral 58*a* in FIG. 5. The magnet 54*a* would also have drainage holes formed therethrough, in alignment with, and shaped the same as the drainage holes 59*a* in the outlet plate 56*a***.

What is claimed is:

1. A sink strainer comprising:

(a) a strainer body having a hollow upper portion and an outlet portion at its lower end;

(b) said outlet portion having an outlet plate of a magnetically attracting material provided with openings for liquid drainage therethrough;

(c) a basket strainer operatively mounted within said hollow body and manually movable between an opened position and a closed position;

(d) said basket strainer having drainage holes formed therethrough and having a rubber stopper on the bottom thereof, for seating on said outlet plate to close the drainage holes in the outlet plate when the basket strainer is in the closed position; and (e) a permanent magnet means embedded within said rubber stopper carried by said sink strainer for magnetically attracting the basket strainer to the sink strainer body outlet plate to assist the water in the sink in creating an efficient sealing action between the rubber stopper and the outlet plate.

2. A sink strainer as defined in claim 1, wherein:

(a) said magnet means is operatively mounted in the rubber stopper and is adapted to create a magnetic attraction to the outlet plate.

3. A sink strainer as defined in claim 1, wherein:

(a) said magnet means is mounted in the outlet portion of the sink strainer body in a position below the outlet plate; and (b) said rubber stopper is provided with a metal insert whereby a magnetic attraction is provided between said metal insert and the magnet, with the outlet plate therebetween, to create a sealing magnetic force between the basket strainer and the outlet.

4. A sink strainer as defined in claim 3, wherein:

(a) the magnet means has a plurality of drainage openings formed therethrough.

* * * * *